US009085153B2

(12) United States Patent
Domae

(10) Patent No.: US 9,085,153 B2
(45) Date of Patent: Jul. 21, 2015

(54) LIQUID JET HEAD, METHOD FOR PRODUCING LIQUID JET HEAD, AND LIQUID JET APPARATUS

(71) Applicant: SII PRINTEK INC., Chiba (JP)

(72) Inventor: Yoshinori Domae, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/103,900

(22) Filed: Dec. 12, 2013

(65) Prior Publication Data

US 2014/0168321 A1 Jun. 19, 2014

(30) Foreign Application Priority Data

Dec. 19, 2012 (JP) ..... 2012-277282

(51) Int. Cl.

| | |
|---|---|
| ***B41J 2/045*** | (2006.01) |
| ***B41J 2/16*** | (2006.01) |
| ***B41J 2/14*** | (2006.01) |

(52) U.S. Cl.

CPC ..... *B41J 2/161* (2013.01); *B41J 2/14209* (2013.01); *B41J 2002/14491* (2013.01); *Y10T 29/49401* (2015.01)

(58) Field of Classification Search

USPC ..... 347/69

See application file for complete search history.

(56) References Cited

U.S. PATENT DOCUMENTS

| | | | | |
|---|---|---|---|---|
| 2002/0005880 | A1 | 1/2002 | Ashe et al. | 347/68 |
| 2012/0236079 | A1 * | 9/2012 | Seki et al. | 347/68 |

FOREIGN PATENT DOCUMENTS

| | | | |
|---|---|---|---|
| EP | 484983 | A2 * | 5/1992 |
| JP | 200961614 | | 3/2009 |
| JP | 2009061614 | A * | 3/2009 |
| JP | 2011093200 | | 5/2011 |

OTHER PUBLICATIONS

Article: Silicon-Nitride, List of properties, entire docuement.*
eFunda Article: Properties of Piezo Material Lead Zirconate Titanate, entire document.*
Machine Translation of JP2009061614A, whole document, Mar. 26, 2009.*

* cited by examiner

*Primary Examiner* — Lisa M Solomon
(74) *Attorney, Agent, or Firm* — Adams & Wilks

(57) ABSTRACT

A liquid jet head includes an actuator substrate on which a plurality of grooves is arranged, and a nozzle plate having nozzle holes communicated with the grooves. Drive electrodes extend in the longitudinal direction along both side surfaces of a wall portion of the grooves. An insulating film is disposed between the wall portion and the longitudinal end portions of the drive electrodes so that only the mid-portion of the drive elecrodes directly contacts the side surfaces of the wall portion. When a voltage is applied to the drive electrodes, only the region of the wall portion in the vicinity of the nozzle holes is actuated to eject liquid from the nozzle holes.

20 Claims, 7 Drawing Sheets

LIQUID JET HEAD, METHOD FOR PRODUCING LIQUID JET HEAD, AND LIQUID JET APPARATUS

BACKGROUND

1. Technical Field

The present invention relates to a liquid jet head and a liquid jet apparatus.

2. Related Art

A liquid jet recording apparatus including a so-called ink jet type liquid jet head that jets liquid from a plurality of nozzle holes toward a recording medium has been conventionally known as an apparatus for recording a character, a graphic, and the like by jetting liquid that is ink or the like on a recoding medium, for example, a piece of recording paper.

For example, the liquid jet head described in JP 2011-93200 A includes a nozzle plate having nozzle holes that jets liquid; a piezoelectric plate having a narrow and long groove on a first side and bonding the nozzle plate to a second side; and a cover plate having a liquid supply hole that supplies liquid to the groove and a liquid discharge hole that discharges the liquid from the groove and being installed on one side of the piezoelectric plate. In the liquid jet head, applying a voltage to a drive electrode deforms the wall portion to change the capacity of the groove. This jets the liquid, with which the groove is filled, from the nozzle holes placed at the longitudinal middle portion of the groove.

By the way, the drive electrode for applying a voltage to the piezoelectric plate is formed at a side surface of the wall portion and along the longitudinal direction of the groove. Generally, a first end of the drive electrode is continuously formed so as to be connected to a terminal formed at a first side of the piezoelectric plate. The second end of the drive electrode is placed at a position biased toward a first side from a second end of the groove in order to prevent the drive electrode from being short-circuited with the other facing drive electrode in the groove.

Thus, generally, the drive electrodes are formed at different ranges in a liquid jet head. One is a position biased toward a first longitudinal side from the position corresponding to the nozzle hole. The other is a position toward a second longitudinal side from the position corresponding to the nozzle hole.

SUMMARY

In a conventional liquid jet head, the range on the first longitudinal side of the wall portion in which the wall portion can be deformed is different from the range on the second longitudinal side of the wall portion, due to the difference of the ranges in which the drive electrodes are formed. Thus, the amount of deformation of the wall portion on the first longitudinal side is different from the amount of deformation of the wall portion on the second longitudinal side when applying a voltage to the drive electrodes of the liquid jet head deforms the wall portion. Further, a pressure wave is propagated toward both of the longitudinal sides off balance at the inside of the liquid with which the groove is filled. Thus, there is a room for improvement in that the pressure wave is propagated toward both of the longitudinal sides in a fine balance at the inside of the liquid with which the groove is filled in order to improve the liquid ejection characteristic.

In light of the foregoing, an objective of the present invention is to provide a liquid jet head capable of improving the liquid ejection characteristic, and a liquid jet apparatus including the liquid jet head.

To solve the problems, the liquid jet head of the present invention includes: an actuator substrate which is divided by a wall portion made of a piezoelectric body and on which a plurality of grooves are arranged and penetrate a first main surface and a second main surface; and a nozzle plate which is installed on the actuator substrate so as to cover an opening on the first main surface of the groove and which includes nozzle holes communicated with the grooves at their longitudinal middle portion; wherein a drive electrode extending from a first longitudinal end to a second longitudinal end in the longitudinal direction and an insulating film covering a part of a side surface of the wall portion are installed on the side surface of the wall portion, and the drive electrode is installed on a surface of the wall portion at a periphery of the nozzle hole and holds the insulating film with the wall portion at least at the first longitudinal end.

According to the present invention, each of the drive electrodes is installed from the first longitudinal end to the second longitudinal end of the wall portion. This can prevent the drive electrodes facing to each other in the grooves at the second longitudinal end from being short-circuited, and can prevent the second longitudinal end of the wall portion from being deformed when applying a voltage to the drive electrodes drives the liquid jet head. Further, the drive electrode holds the insulating film with the wall portion at least at the first longitudinal end. This can prevent the first longitudinal end of the wall portion from being deformed when applying a voltage to the drive electrodes drives the liquid jet head. This can deform the wall portion at the periphery of the nozzle hole and can prevent both of the longitudinal ends of the wall portion from being deformed when applying a voltage to the drive electrodes drives the liquid jet head. The pressure wave generated at the deformation of the wall portion can be propagated toward both of the longitudinal sides around the central axis of the nozzle hole in a fine balance, at the inside of the liquid with which the groove is filled, because only the wall portion at the periphery of the nozzle hole can be deformed. Thus, the liquid ejection characteristic can be improved.

In the liquid jet head, the drive electrode is separated from the nozzle plate.

The present invention can bend and deform only the area in the wall portion on which the drive electrode is installed by driving the area because the drive electrode is separated from the nozzle hole.

In the liquid jet head, the drive electrode holds the insulating films with the wall portion at both of the longitudinal ends.

The present invention can surely prevent both of the longitudinal sides of the wall portion from being deformed when applying a voltage to the drive electrodes drives the liquid jet head. This can deform the wall portion only around the nozzle hole and can propagate the pressure wave toward both of the longitudinal sides around the central axis of the nozzle hole at the inside of the liquid with which the groove is filled. This can further improve the liquid ejection characteristic.

In the liquid jet head, the drive electrode further holds the insulating films with the wall portion at a position corresponding to the nozzle hole.

The present invention can prevent the part in the wall portion corresponding to the nozzle hole from being deformed and can deform the periphery except for the part corresponding to the nozzle hole in the wall portion when applying a voltage to the drive electrodes drives the liquid jet head. This can propagate the pressure wave generated at the deformation of the wall portion toward both of the longitudinal sides around the central axis of the nozzle hole in a fine balance at the inside of the liquid with which the groove is filled. Further, installing the drive electrode at the position corresponding to the nozzle hole and holding an insulating film with the wall portion can prevent an electric field from appearing at the position corresponding to the nozzle hole when a voltage is applied to the drive electrode. Thus, the power consumption can be reduced while a favorable ejection characteristic is maintained.

In the liquid jet head, an effective drive electrode area of the drive electrode that does not hold the insulating film with the wall portion is provided so as to be symmetry with respect to a plane of a virtual surface which is perpendicular to the longitudinal direction and which includes a central axis of the nozzle hole.

The present invention provides the effective drive electrode area that does not hold the insulating film with the wall portion such that the effective drive electrode area is symmetry with respect to the plane of the virtual surface. This can deform the wall portion such that the wall portion is symmetry with respect to the plane of the virtual surface when applying a voltage to the drive electrodes drives the liquid jet head. Accordingly, the pressure wave generated at the deformation of the wall portion can be propagated in a fine balance at the inside of the liquid with which the groove is filled, such that the pressure wave is symmetry with respect to the plane of the virtual surface. Thus, the liquid ejection characteristic can drastically be improved. Further, the part in the wall portion corresponding to the area excluding the effective drive electrode area is not unnecessarily driven. This can reduce the resonance points in the wall portion when applying a voltage to the drive electrodes drives the liquid jet head. This can prevent a resonance in the wall portion when the liquid jet head is driven and thus can improve the liquid ejection characteristic.

The liquid jet head further includes a cover plate which is installed on the actuator substrate so as to cover an opening on the second main surface of the groove and which includes a liquid supply chamber that supplies liquid to the groove, wherein a predetermined area of the groove which is a periphery of the nozzle hole and which is an area excluding an area corresponding to the liquid supply chamber is a pump area, and both of longitudinal edges of the effective drive electrode area are placed in the pump area.

The present invention places both of the longitudinal edges of the effective drive electrode area in the pump area so that only the wall portion in the pump area can be driven when applying a voltage to the drive electrodes drives the liquid jet head. Thus, the wall portion excluding the pump area is not unnecessarily driven. This can prevent the resonance in the wall portion by reducing the resonance points in the wall portion.

The liquid jet head further includes a cover plate which is installed on the actuator substrate so as to cover an opening on the second main surface of the groove and which includes a liquid supply chamber that supplies liquid to the groove, wherein a predetermined area of the groove which is a periphery of the nozzle hole and which is an area excluding an area corresponding to the liquid supply chamber is a pump area, and both of longitudinal edges of the effective drive electrode area are placed along a boundary between the pump area and a non-pump area.

The present invention places both of the edges of the effective drive electrode area along the boundary between the pump area and the non-pump area. This allows driving only the wall portion corresponding to the pump area and can prevent the wall portion excluding the pump area from unnecessarily being driven. This can prevent the resonance in the wall portion.

In the liquid jet head, the cover plate includes a liquid discharge chamber that discharges the liquid from the groove, the liquid supply chamber is communicated with the first longitudinal end of the groove, the liquid discharge chamber is communicated with the second longitudinal end of the groove, and an area of the groove corresponding to an area between the liquid supply chamber and the liquid discharge chamber is the pump area.

The present invention can preferably apply the above-mentioned configuration capable of improving the liquid ejection characteristic to a so-called flow-through type liquid jet head.

In the liquid jet head, a plurality of the grooves are ejection grooves and non-ejection grooves that are alternately arranged, and the liquid supply chamber and the liquid discharge chamber are communicated with the ejection grooves.

The present invention can preferably apply the above-mentioned configuration capable of improving the liquid ejection characteristic to a flow-through type liquid jet head including the ejection grooves and the non-ejection grooves.

In the liquid jet head, a material forming the insulating film has a smaller relative permittivity than that of the piezoelectric body forming the wall portion.

According to the present invention, the material forming the insulating film has a smaller relative permittivity than that of the piezoelectric body forming the wall portion. This can reduce the capacitance between the insulating films that hold the wall portion therebetween when the drive electrodes hold the insulating films with the wall portion. This can surely prevent the part corresponding to the insulating films in the wall portion from being driven when the liquid jet head is driven.

In the liquid jet head, the material forming the insulating film is mainly made of $SiO_2$.

The present invention forms the insulating film using the material mainly made of $SiO_2$. This allows forming of a highly reliable liquid jet head with a beneficial adhesion of the insulating film and the drive electrode.

The liquid jet apparatus of the present invention is a method for producing the above-described liquid jet head that includes installing an insulating film mask on the piezoelectric body substrate, forming a film of an insulating material on the piezoelectric body substrate, installing a drive electrode mask having an opened part corresponding to an area on which a film of the drive electrode is to be formed, and forming a film of a piezoelectric material of the drive electrode.

The present invention can produce a liquid jet head capable of improving the liquid ejection characteristic.

The liquid jet apparatus of the present invention includes; a moving mechanism configured to move the liquid jet head and a recording medium relative to each other; a liquid supply tube configured to supply liquid to the liquid jet head; and a liquid tank configured to supply the liquid to the liquid supply tube.

The present invention includes a liquid jet head capable of improving the liquid ejection characteristic so that a high-performance liquid jet apparatus can be formed.

According to the present invention, each of the drive electrodes is installed from the first longitudinal end to the second longitudinal end of the wall portion. This can prevent the drive electrodes facing to each other in the grooves at the second longitudinal end from being short-circuited, and can prevent the second longitudinal end of the wall portion from being deformed when applying a voltage to the drive electrodes drives the liquid jet head. Further, the drive electrode holds the insulating film with the wall portion at least at the first longitudinal end. This can prevent the first longitudinal end of the wall portion from being deformed when applying a voltage to the drive electrodes drives the liquid jet head. This can deform the wall portion at the periphery of the nozzle hole and can prevent both of the longitudinal ends of the wall portion from being deformed when applying a voltage to the drive electrodes drives the liquid jet head. The pressure wave generated at the deformation of the wall portion can be propagated toward both of the longitudinal sides around the central axis of the nozzle hole in a fine balance, at the inside of the liquid with which the groove is filled, because only the wall portion at the periphery of the nozzle hole can be deformed. Thus, the liquid ejection characteristic can be improved.

DETAILED DESCRIPTION

Hereinafter, the embodiment of the present invention will be described using the drawings.

Figure 1:
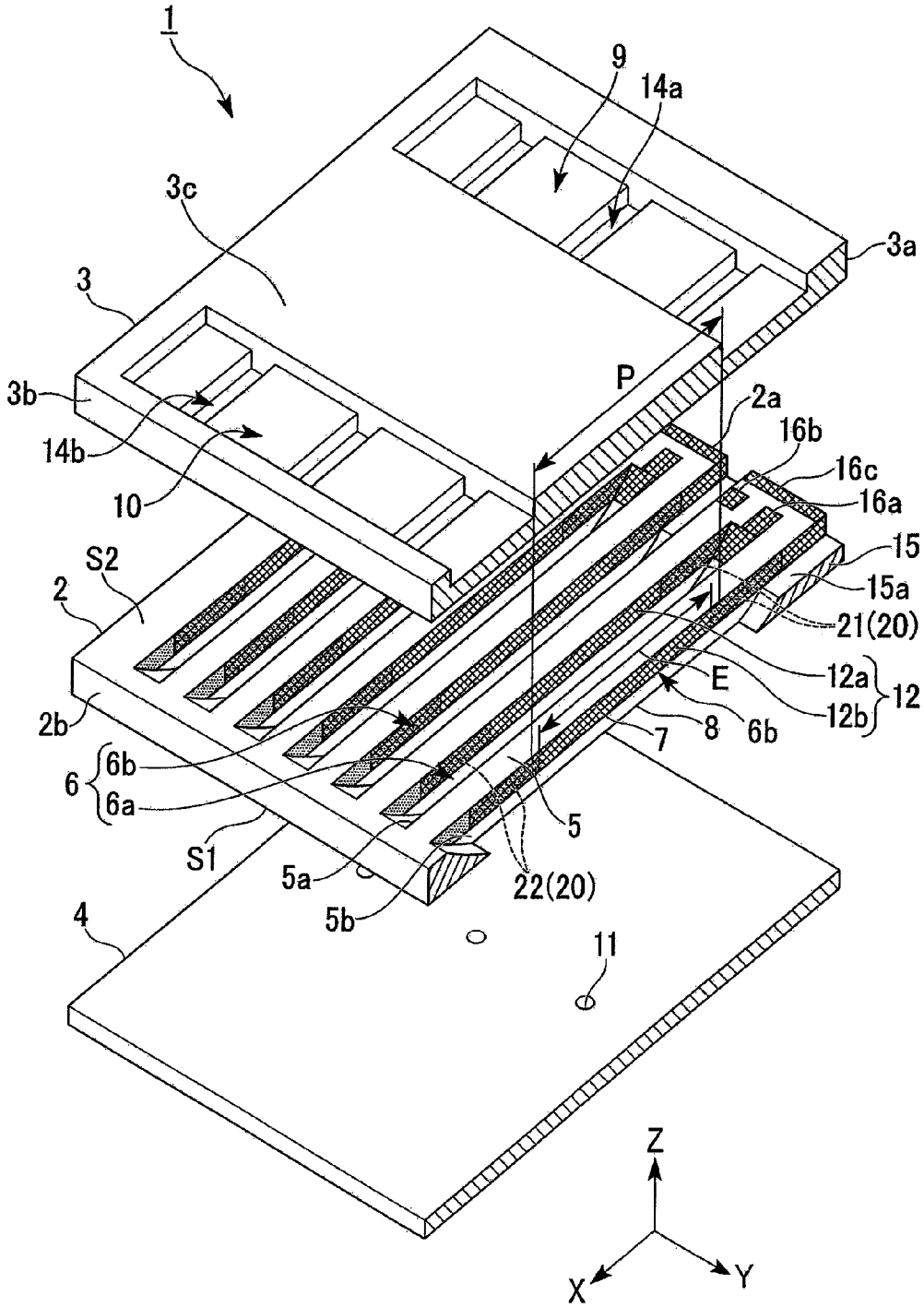
FIG. 1 is an exploded perspective view of a liquid jet head according to an embodiment.

FIG. 1 is an exploded perspective view of a liquid jet head 1 according to one exemplary embodiment.

Figure 2A:
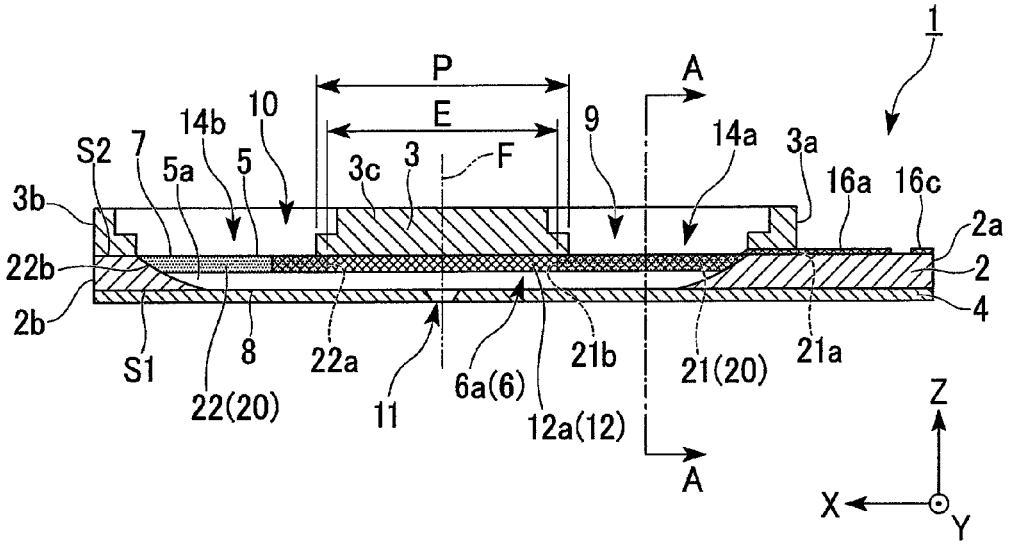
FIGS. 2A and 2B are diagrams illustrating the liquid jet head according to the embodiment.
Figure 2B:
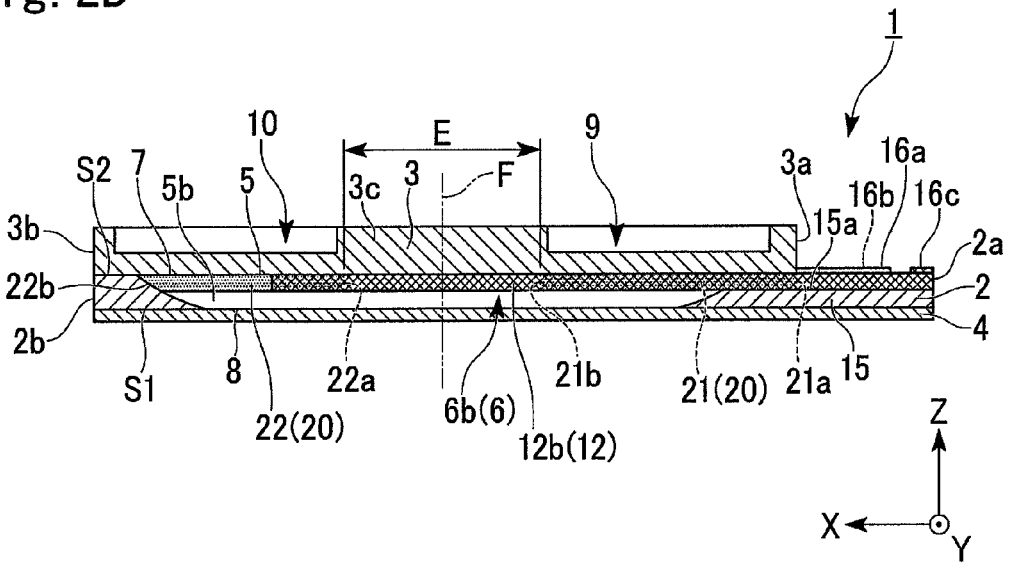

FIGS. 2A and 2B are diagrams illustrating the liquid jet head 1 according to the embodiment. FIG. 2A is a side cross-sectional view taken along the longitudinal direction of an ejection groove 6*a*. FIG. 2B is a side cross-sectional view taken along the longitudinal direction of a non-ejection groove 6*b*. For simplicity's sake, drive electrodes 12 are cross-hatched and insulating films 20 are dot-hatched in FIGS. 1, 2A, and 2B.

As illustrated in FIG. 1, the liquid jet head 1 in the present embodiment includes an actuator substrate 2, a cover plate 3, and a nozzle plate 4.

The actuator substrate 2 is divided by a wall portion 5 made of a piezoelectric body and includes a plurality of grooves 6 including the ejection grooves 6*a* and the non-ejection grooves 6*b* that are arranged on the actuator substrate 2 and penetrate a first main surface S1 and a second main surface S2. The cover plate 3 is installed on the actuator substrate 2 so as to cover a second opening 7 on the second main surface S2 side of the groove 6. The cover plate 3 includes a liquid supply chamber 9 configured to supply liquid from a first longitudinal side of the groove 6 to the ejection groove 6*a*, and a liquid discharge chamber 10 configured to discharge the liquid from the ejection groove 6*a* to the second longitudinal side of the groove 6. The nozzle plate 4 includes nozzle holes 11 communicated with the ejection grooves 6*a*. The nozzle plate 4 is installed on the actuator substrate 2 so as to cover a first opening 8 on the first main surface S1 side of the grooves 6.

Note that, hereinafter, the longitudinal direction in which the grooves 6 extend is referred to as an X direction. A first side on which the liquid supply chamber 9 is placed is referred to as a −X side, and a second side on which the liquid discharge chamber 10 is placed is referred to as a +X side. The width direction of the grooves 6 perpendicular to the longitudinal direction is referred to as a Y direction. The left side on the paper of FIG. 1 is referred to as a −Y side, and the right side on the paper of FIG. 1 is referred to as a +Y side. The direction perpendicular to the X direction and the Y direction is referred to as a Z direction. The first main surface S1 side is referred to as a −Z side, and the second main surface S2 side is referred to as a +Z side. Hereinafter, the orthogonal coordinate system of the X, Y, and Z is used in the description as necessary.

(Actuator Substrate)

Hereinafter, each component of the liquid jet head 1 will be described in detail.

The actuator substrate 2 is formed into an approximately rectangular plate with a piezoelectric material, for example, PZT ceramics that is polarized in the Z direction.

The grooves 6 on the actuator substrate 2 are the ejection grooves 6*a* and the non-ejection grooves 6*b* that are alternately arranged in the Y direction.

As illustrated in FIG. 2A, each of the −X side end and the +X side end of the ejection groove 6*a* inclines as turning up from the −Z side (the first main surface S1 side) of the actuator substrate 2 to the +Z side (the second main surface S2 side). The ejection groove 6*a* is formed between a position biased toward the +X side from a −X side end 2*a* of the actuator substrate 2 and a −X side end 3*a* of the cover plate 3, and a position biased toward the −X side from a +X side end 2*b* of the actuator substrate 2.

As illustrated in FIG. 2B, the +X side end of the non-ejection groove 6*b* inclines as turning up from the −Z side to the +Z side of the actuator substrate 2 in the same manner as the ejection groove 6*a*. The −X side end of the non-ejection groove 6*b* extends to the −X side end 2*a* of the actuator substrate 2. A raised bottom 15 that is the remaining actuator substrate 2 is formed on the bottom of the non-ejection groove 6*b* near the −X side end 2*a*. A +Z side surface 15*a* of the raised bottom 15 is formed approximately parallel to the first main surface S1 with being placed on the +Z side away from the first main surface S1. The raised bottom 15 inclines as turning up from the −Z side to the +Z side while being continuously formed toward the +Z side surface 15*a* of the raised bottom 15.

As illustrated in FIG. 1, the drive electrode 12 is placed on each side surface of the wall portion 5 as extending in the X direction. The drive electrode 12 will be described in detail below.

(Cover Plate)

The cover plate 3 is formed into an approximately rectangular plate with, for example, PZT ceramics that is the same material as that of the actuator substrate 2. Note that the material forming the cover plate 3 is not limited to the PZT ceramics. For example, machinable ceramics, other ceramics, or low dielectric materials such as glass can be used. However, forming the cover plate 3 and the actuator substrate 2 using the same material can equalize the thermal expansions of the cover plate 3 and the actuator substrate 2. This can prevent the warp or deformation of the liquid jet head 1 in response to temperature changes.

As illustrated in FIGS. 2A and 2B, the cover plate 3 includes the liquid supply chamber 9 on the −X side of the actuator substrate 2, the liquid discharge chamber 10 on the +X side of the actuator substrate 2, and a body portion 3*c* between the liquid supply chamber 9 and the liquid discharge chamber 10. The cover plate 3 is placed so as to cover the ejection grooves 6*a* and the non-ejection grooves 6*b*. The cover plate 3 is bonded and fixed to the second main surface S2 of the actuator substrate 2, for example, using an adhesive agent. At that time, as illustrated in FIG. 2A, the +Z side end in an area corresponding to the body portion 3*c* of the cover plate 3 in the wall portion 5 forming the ejection groove 6*a* coheres with and is strongly fixed to the body portion 3*c* of the cover plate 3.

As illustrated in FIGS. 2A and 2B, the X direction length of the cover plate 3 is shorter than the X direction length of the actuator substrate 2. The cover plate 3 is placed such that the +X side end 3*b* is approximately flush with the +X side end 2*b* of the actuator substrate 2, and the −X side end 3*a* is placed on the +X side away from the −X side end 2*a* of the actuator substrate 2. Thus, an area on the −X side away from −X side end 3*a* of the cover plate 3 in the second main surface S2 of the actuator substrate 2 is exposed to the outside.

As illustrated in FIG. 1, the liquid supply chamber 9 includes a plurality of first slits 14*a* on the bottom. The first slits 14*a* are formed by penetrating the positions correspond to the ejection grooves 6*a* on the bottom of the liquid supply chamber 9 in the Z direction. The first slits 14*a* extend in the X direction and are arranged in the Y direction. As illustrated in FIG. 2A, the liquid supply chamber 9 is communicated with the −X side end of the ejection groove 6*a* through the first slit 14*a*. Note that the liquid supply chamber 9 is not communicated with the non-ejection groove 6*b* (see FIG. 2B).

As illustrated in FIG. 1, the liquid discharge chamber 10 includes a plurality of second slits 14*b* on the bottom. The second slits 14*b* are formed by penetrating the positions correspond to the ejection grooves 6*a* on the bottom of the liquid discharge chamber 10 in the Z direction. The second slits 14*b* extend in the X direction, and are arranged in the Y direction. As illustrated in FIG. 2A, the liquid discharge chamber 10 is communicated with the +X side end of the ejection groove 6*a* through the second slit 14*b*. Note that the liquid discharge chamber 10 is not communicated with the non-ejection groove 6*b* (see FIG. 2B).

The liquid supplied to the liquid supply chamber 9 flows into the ejection groove 6*a* through the first slit 14*a* and is discharged from the ejection groove 6*a* to the liquid discharge chamber 10 through the second slit 14*b*. In other words, the liquid jet head 1 in the present embodiment is a so-called flow-through type liquid jet head. Note that the liquid does not flow into the non-ejection groove 6*b* because the non-ejection groove 6*b* is not communicated with either the liquid supply chamber 9 or the liquid discharge chamber 10, as illustrated in FIG. 2B.

The cover plate 3 preferably has a thickness, for example, of 0.3 to 1.0 mm. The cover plate 3 having a thickness less than 0.3 mm is inferior in strength. The cover plate 3 having a thickness more than 1.0 mm requires a longer time to process the liquid supply chamber 9, the liquid discharge chamber 10, the first slits 14*a*, the second slits 14*b*, and the like, and increases the cost due to the increase in the amount of the materials to be used.

(Nozzle Plate)

As illustrated in FIG. 2A, the nozzle plate 4 is a component formed into a thin film made of a synthetic resin material, for example, polyimide or polypropylene, or a metallic material. The nozzle plate 4 is formed into an approximately rectangle corresponding to the external form of the actuator substrate 2 when being viewed in the Z direction.

The nozzle plate 4 is bonded and fixed to the first main surface S1 of the actuator substrate 2, for example, with an adhesive agent so as to cover the first openings 8 the ejection groove 6*a* and the non-ejection groove 6*b* on the first main surface S1 side. The nozzle plate 4 includes the nozzle holes 11 communicated with the ejection grooves 6*a* at the middle portion of the ejection groove 6*a* in the X direction. The nozzle hole 11 gradually decreases in diameter from the +Z side to the −Z side.

The nozzle plate 4 preferably has a thickness, for example, 0.01 to 0.1 mm. The nozzle plate 4 having a thickness less than 0.01 mm reduces the strength. The nozzle plate 4 having a thickness more than 0.1 mm transfers the vibration to the nozzle holes 11 adjoining to each other and thus facilitates a crosstalk.

In that case, the PZT cramics have a Young's modulus of 58.48 GPa and the polyimide has a Young's modulus of 3.4 GPa. Thus, using the PZT ceramics as the cover plate 3 and using a polyimide film as the nozzle plate 4 makes the stiffness of the cover plate 3 covering the second main surface S2 of the actuator substrate 2 higher than the stiffness of the nozzle plate 4 covering the first main surface S1.

The material of the cover plate 3 has preferably a Young's modulus, for example, not less than 40 GPa. The material of the nozzle plate 4 has preferably a Young's modulus, for example, within a range between 1.5 and 30 GPa. The nozzle plate 4 having a Young's modulus less than 1.5 GPa reduces the reliablity because the nozzle plate 4 is easily scratched when contacting a recoding medium. The nozzle plate 4 having a Young's modulus exceeding 30 GPa transfers the vibration to the nozzle holes 11 adjoining to each other and thus facilitates a crosstalk.

(Drive Electrode)

As illustrated in FIG. 1, the drive electrodes 12 are formed on the sides of the wall portion 5 on the actuator substrate 2 of the liquid jet head 1.

The drive electrodes 12 includes a common electrode 12*a* installed on a side surface 5*a* facing the ejection groove 6*a* among the side surfaces of the wall portion 5, and an active electrode 12*b* installed on a side surface 5*b* facing the non-ejection groove 6*b* among the side surfaces of the wall portion 5.

The common electrodes 12*a* are formed into an approximate band shape and extend in the X direction from the −X side ends of the side surfaces 5*a* and 5*a* of a pair of the wall portions 5 and 5 facing the ejection groove 6*a* to the positions biased toward the −X side from the +X side end. A pair of the common electrodes 12*a* and 12*a* formed on the side surfaces 5*a* and 5*a* of the ejection groove 6*a* are electrically connected to each other (See FIG. 1).

The active electrodes 12*b* are formed into an approximate band shape and extend in the X direction from the −X side ends of the side surfaces 5*b* and 5*b* of a pair of the wall portions 5 and 5 facing the non-ejection groove 6*b* to the positions biased toward the −X side from the +X side end. A pair of the active electrodes 12*b* and 12*b* formed on the side surfaces 5*b* and 5*b* of the non-ejection groove 6*b* are electrically separated from each other (See FIG. 1).

As illustrated in FIGS. 2A and 2B, the common electrode 12*a* and the active electrode 12*b* are separated from the nozzle plate 4 forming the bottom surfaces of the ejection groove 6*a* and the non-ejection groove 6*b*. The common electrode 12*a* and the active electrode 12*b* are respectively installed, for example, on the +Z side away from the +Z side surface 15*a* of the raised bottom 15 in the present embodiment.

As illustrated in FIG. 1, a common terminal 16*a* electrically connected to the common electrode 12*a*, an active terminal 16*b* electrically connected to the active electrode 12*b*, and a wiring 16*c* electrically connecting the active electrodes 12*b* formed at adjoining non-ejection grooves 6*b* are installed in an area biased toward the −X side from the −X side end 3*a* of the cover plate 3 on the second main surface S2 of the actuator substrate 2.

Each of the common terminal 16*a* and the active terminal 16*b* is a land connected to a wiring electrode on a flexible substrate (not illustrated in the drawings). The active terminal 16*b* is electrically connected to the active electrode 12*b* formed on the side surface 5*b* that faces the non-ejection groove 6*b* on a first wall portion 5 (on the −Y side in the present embodiment) of a pair of the wall portion 5 and 5 that place the ejection groove 6*a* therebetween. The active terminal 16*b* is electrically connected through the wiring 16*c* formed along an edge of the −X side end 2*a* of the actuator substrate 2 to the active electrode 12*b* formed on the side surface 5*b* that faces the non-ejection groove 6*b* on a second wall portion 5 (on the +Y side in the present embodiment).

As illustrated in FIG. 2A, the +Z side end and the −Z side end in an area corresponding to the body portion 3*c* on the cover plate 3 in the wall portion 5 forming the ejection grooves 6*a* each cohere with and are strongly fixed to the body portion 3*c* on the cover plate 3 and the nozzle plate 4. Thus, giving drive signals to the common terminal 16*a* and the active terminal 16*b* can warp and deform the Z-direction middle portion of the wall portion 5 in the Y direction with fixing both of the Z-direction ends of the wall portion 5 in the area corresponding to the body portion 3*c* on the cover plate 3. This generates a pressure wave in the liquid in the ejection groove 6*a* and can eject the liquid from the nozzle holes 11. In other words, the area in the ejection groove 6*a* that is near the nozzle hole 11 and that corresponds to the body portion 3*c* on the cover plate 3 can function as a pump portion. Hereinafter, the area in the ejection groove 6*a* that corresponds to the body portion 3*c* on the cover plate 3 (the area corresponding to the area between the liquid supply chamber 9 and the liquid discharge chamber 10) is defined as a pump area P. The area in the ejection groove 6*a* that corresponding to the first slit 14*a* in the liquid supply chamber 9 and the area in the ejection groove 6*a* that corresponds to the second slit 14*b* in the liquid discharge chamber 10 (the areas except the pump area P) each are defined as a non-pump area.

As illustrated in FIGS. 2A and 2B, each of the drive electrodes 12 (12*a* and 12*b*) is installed on the front surface of the wall portion 5 around the nozzle hole 11 and hold the insulating films 20 with the wall portion 5 at both of the X direction ends.

The insulating film 20 is formed of a material mainly made of, for example, silicon dioxide ($SiO_2$). Note that the material forming the insulating film 20 is not limited to $SiO_2$. Any material that has a smaller relative permittivity than that of the piezoelectric body forming the actuator substrate 2 can be used. Specifically, the material forming the insulating film 20 can be, for example, silicon nitride ($Si_3N_4$) or aluminum oxide ($Al_2O_3$) in addition to $SiO_2$.

As illustrated in FIGS. 2A and 2B, the insulating films 20 include a first insulating film 21 installed at each of the ûX side ends of the side surfaces 5*a* and 5*b* of the wall portion 5, and a second insulating film 22 installed at each of the +X side ends of the side surfaces 5*a* and 5*b* of the wall portion 5. Note that the first insulating film 21 and the second insulating film 22 installed on the side surface 5*a* facing the ejection groove 6*a* in the wall portion 5 has the same structure as the first insulating film 21 and the second insulating film 22 installed on the side surface 5*b* facing the non-ejection groove 6*b* in the wall portion 5. Thus, hereinafter, only the first insulating film 21 and the second insulating film 22 installed on the side surface 5*a* facing the ejection groove 6*a* in the wall portion 5 will be described. The detailed description of the first insulating film 21 and the second insulating film 22 installed on the side surface 5*b* facing the non-ejection groove 6*b* in the wall portion 5 will not be repeated.

Figure 3:
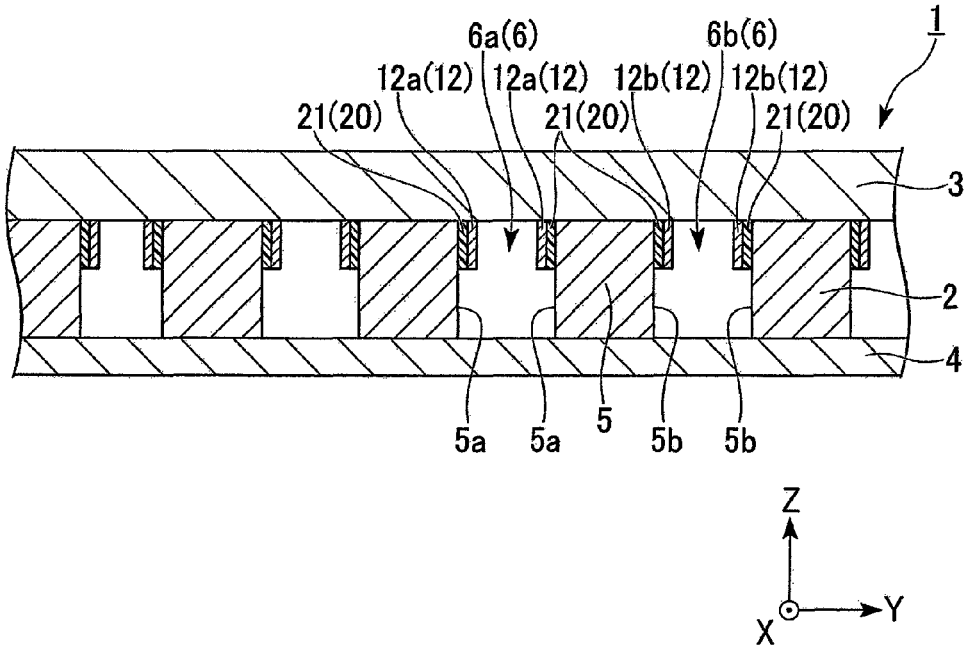
FIG. 3 is a cross-sectional view taken along a line A-A of FIG. 2A.

FIG. 3 is a cross-sectional view taken along the line A-A of FIG. 2A. As illustrated in FIG. 3, each of the first insulating films 21 is provided between the common electrode 12*a* and the side surface 5*a* of the wall portion 5. As illustrated in FIG. 2A, the first insulating film 21 has about the same width as the common electrode 12*a* in the Z direction or has a slightly wider width than the common electrode 12*a* in the Z direction, and extends in the X direction. A −X side end 21*a* of the first insulating film 21 is placed at a position corresponding to the −X side end 3*a* of the cover plate 3. A +X side end 21*b* of the first insulating film 21 is placed at a position slightly biased toward the +X side from the boundary between the pump area P and the non-pump area corresponding to the first slit 14*a*, and is placed in the pump area P.

A −X side end 22*a* of the second insulating film 22 is provided between the +X side end of the common electrode 12*a* and the side surface 5*a* of the wall portion 5. A +X side end 22*b* of the second insulating film 22 is exposed. The second insulating film 22 has about the same width as the common electrode 12*a* in the Z direction or has a slightly wider width than the common electrode 12*a* in the Z direction, and extends in the X direction.

The −X side end 22*a* of the second insulating film 22 is placed at a position slightly biased toward the −X side from the boundary between the pump area P and the non-pump area corresponding to the second slit 14*b*, and is placed in the pump area P. The +X side end 22*b* of the second insulating film 22 is placed at the +X side end of the ejection groove 6*a*.

As illustrated in FIGS. 2A and 2B, the area in the drive electrode 12 (12*a* or 12*b*) that does not hold the insulating films 21 and 22 with the wall portion 5 is an effective drive electrode area E in which an electric field can be generated when a voltage is applied to the drive electrode 12 (12*a* or 12*b*). Herein, on the assumption of a virtual surface F being perpendicular to the X direction and including the central axis of the nozzle hole 11, the effective drive electrode area E is symmetrical with respect to the plane of the virtual surface. F. Thus, when applying a voltage to the drive electrodes 12 to drive the liquid jet head 1, the wall portion 5 can be deformed so as to be symmetrical with respect to the plane of the virtual surface F.

Figure 4:
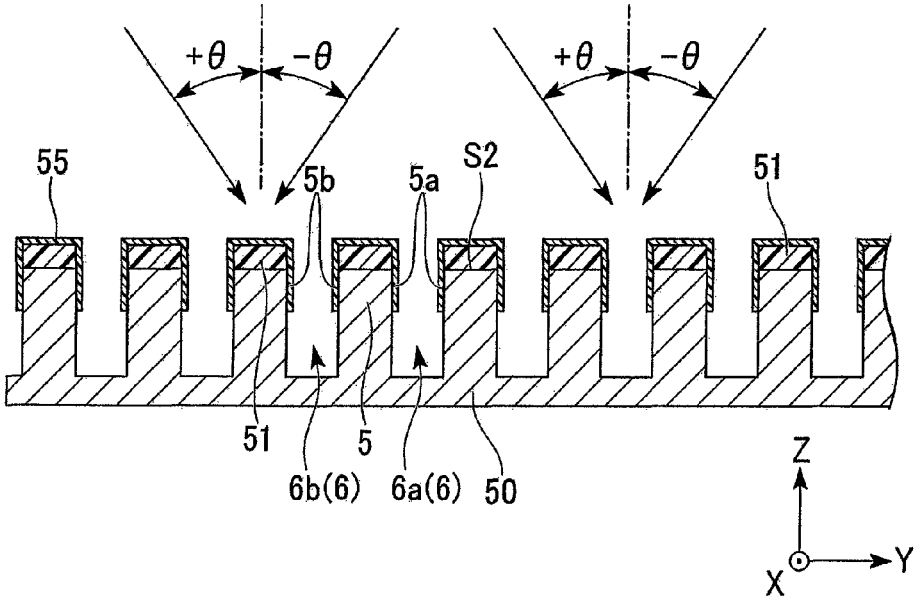
FIG. 4 is a diagram illustrating a process for forming insulating films.
Figure 5:
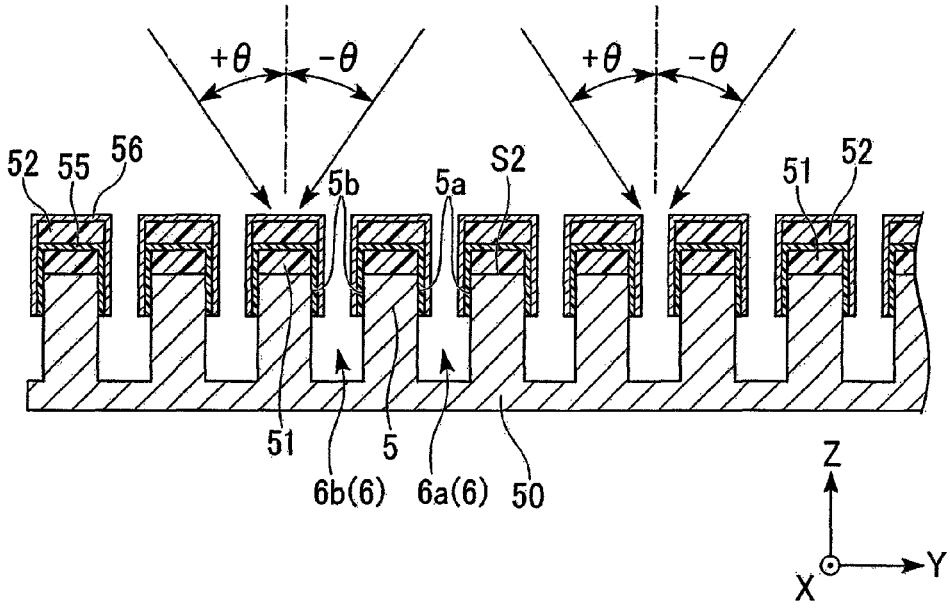
FIG. 5 is a diagram illustrating a process for forming drive electrodes.
Figure 6:
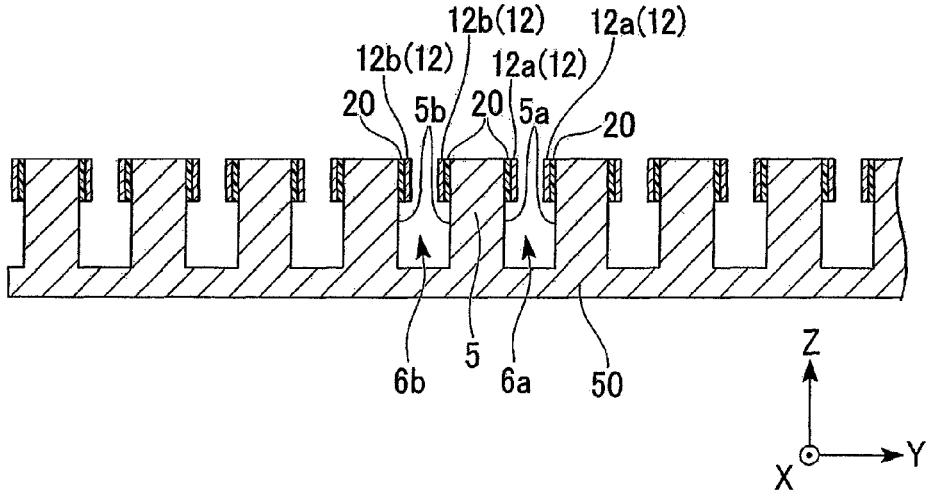
FIG. 6 is a diagram illustrating a status after the insulating films and the drive electrodes have been formed.

FIG. 4 is a diagram illustrating a process for forming the insulating films 20 (see FIGS. 2A and 2B). FIG. 5 is a diagram illustrating a process for forming the drive electrodes 12 (see FIGS. 2A and 2B). FIG. 6 is a diagram illustrating a status after the insulating films 20 and the drive electrodes 12 have been formed. Note that FIGS. 4 to 6 are cross-sectional views taken along the line A-A of FIG. 2A.

The insulating films 20 (21 and 22) and the drive electrodes 12 (12*a* and 12*b*) are formed, for example, by oblique deposition.

Specifically, as illustrated in FIG. 4, an insulating film mask 51 having an opened portion corresponding to the area excluding the effective drive electrode area E (see FIGS. 2A and 2B) is installed on a piezoelectric body substrate 50 on which the grooves 6 are formed, for example, by photolithography technique (a process for providing an insulating film mask). An insulating material 55 is evaporated onto the second main surface S2 of the piezoelectric body substrate 50 in directions inclined at predetermined angles +θ and −θ to the Y direction from the Z direction by the deposition (a process for forming a film of an insulating material). Note that the insulating material 55 is not formed on the effective drive electrode area E (see FIGS. 2A and 2B) because the effective drive electrode area E is covered with the insulating film mask 51 at that time.

Next, as illustrated in FIG. 5, a drive electrode mask 52 having an opened portion corresponding to the area in which a film is formed in the drive electrodes 12 (see FIG. 1) is installed on the piezoelectric body substrate 50 on which the insulating material 55 has been formed, for example, by photolithography technique as being deposited on the insulating material 55 (a process for installing a drive electrode mask). Similarly to the formation of the insulating film 20, an electrode material 56 is evaporated onto the second main surface S2 of the piezoelectric body substrate 50 in directions inclined at predetermined angles +θ and −θ to the Y direction from the Z direction by the deposition (a process for forming an drive electrode film). This directly forms a film of the electrode material 56 on both of the side surfaces 5*a* and 5*b* of the wall portion 5 in the effective drive electrode area E (see FIGS. 2A and 2B). This also forms a film of the electrode material 56 on both of the side surfaces 5*a* and 5*b* of the wall portion 5 through the insulating material 55 in the area excluding the effective drive electrode area E.

Next, as illustrated in FIG. 6, the insulating film mask 51 and the drive electrode mask 52 are removed, for example, by lift-off technique at the same time as the insulating material 55 on the insulating film mask 51 and the electrode material 56 on the drive electrode mask 52 are removed. This divides the electrode material 56 deposited on both of the side surfaces 5*a* and 5*b* of the wall portion 5. Then, the common electrode 12*a* and the active electrode 12*b* are formed. Thus, the common electrode 12*a* and the active electrode 12*b* are installed on both of the side surfaces 5*a* and 5*b* of the wall portion 5 while holding the insulating film 20 with the wall portion 5 at both of the X direction ends.

The liquid jet head 1 operates as follows. See FIGS. 1 to 3 for the reference signs of components in the description of the operation of the liquid jet head 1 to be described below.

Liquid is supplied to the liquid supply chamber 9 and discharged from the liquid discharge chamber 10 to be circulated. Giving drive signals to the common terminal 16*a* and the active terminal 16*b* deforms a pair of the wall portions 5 and 5 forming the ejection groove 6*a* by thickness shear deformation. At that time, the Z-direction middle portion of the wall portion 5 corresponding to the effective drive electrode area E of the wall portions 5 and 5 is bent and deformed, for example, toward the inside of the ejection groove 6*a*. This generates a pressure wave in the liquid in the ejection groove 6*a* and thus ejects the liquid from the nozzle holes 11 communicated with the ejection grooves 6*a*. The effective drive electrode area E is symmetrical with respect to the plane of the virtual surface F in the present embodiment. Thus, when applying a voltage to the common terminal 16*a* and the active terminal 16*b* drives the liquid jet head 1, the wall portion 5 can be deformed so as to be symmetrical with respect to the plane of the virtual surface F. Therefore, the pressure wave generated at the deformation of the wall portion 5 is propagated toward both of the Y direction sides around the central axis of the nozzle hole 11 in a fine balance at the inside of the liquid with which the ejection groove 6*a* is filled.

Figure 7:
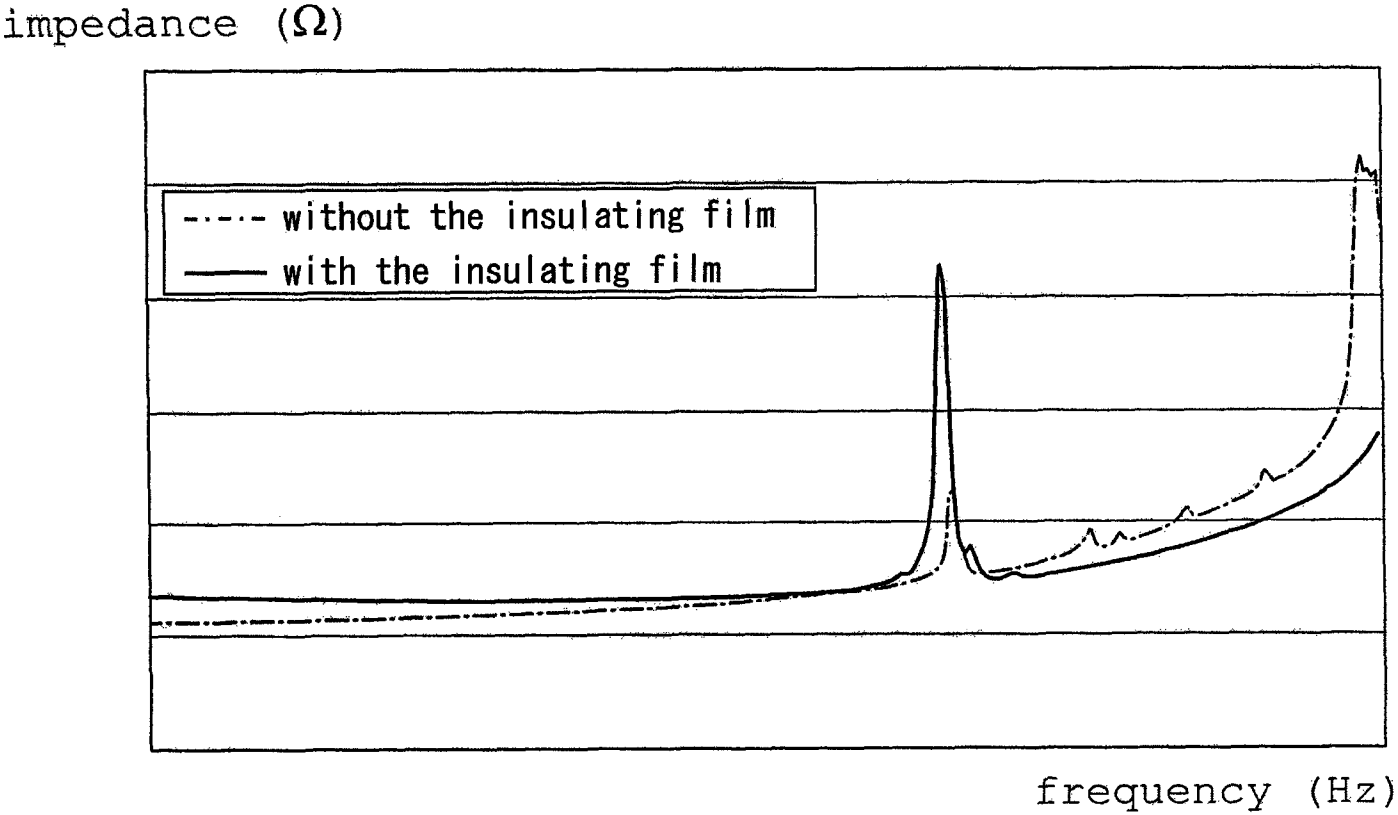
FIG. 7 is a graph of the resonance characteristics with and without the insulating film.

FIG. 7 is a graph of the resonance characteristics with and without the insulating film while showing the frequency (Hz) as the horizontal axis and the impedance (Ω) as the vertical axis. Note that the point at which the impedance rapidly rises is a resonance point.

The alternate long and short line of the graph in FIG. 7 shows the frequency-impedance characteristic when a liquid jet head is driven while the drive electrodes 12 (12*a* and 12*b*) are directly installed on both of the side surfaces 5*a* and 5*b* of the wall portion 5 without providing the insulating films 20 (21 and 22) illustrated in FIG. 1. The solid line of the graph in FIG. 7 shows the frequency-impedance characteristic when the liquid jet head 1 is driven while the drive electrodes 12 (12*a* and 12*b*) are directly installed on both of the side surfaces 5*a* and 5*b* of the wall portion 5 with holding the insulating films 20 with the wall portion 5 at both of the X direction ends as the embodiment described above.

It should be understood from FIG. 7 that there is a plurality of resonance points at which the impedance rapidly rises when the drive electrodes 12 (12*a* and 12*b*) are directly installed on both of the side surfaces 5*a* and 5*b* of the wall portion 5 without providing the insulating films 20 (21 and 22) (the alternate long and short line of the graph). On the other hand, there is no resonance point in the frequency bands excluding the natural frequency when the drive electrodes 12 (12*a* and 12*b*) are directly installed on both of the side surfaces 5*a* and 5*b* of the wall portion 5 with holding the insulating films 20 with the wall portion 5 in the liquid jet head 1 according to the embodiment (the solid line of the graph).

As described above, in the liquid jet head 1 according to the embodiment, the drive electrodes 12 (12*a* and 12*b*) are installed on both of the side surfaces 5*a* and 5*b* of the wall portion 5 while holding the insulating films 20 with the wall portion 5 at both of the X direction ends. The effective drive electrode area E that does not hold the insulating films 21 and 22 with the wall portion 5 is provided so as to be symmetrical with respect to the plane of the virtual surface F that includes the central axis of the nozzle hole 11. Thus, when the liquid jet head 1 is driven, the wall portion 5 is deformed so as to be symmetrical with respect to the plane of the virtual surface F. Further, both of the X direction edges of the effective drive electrode area E are placed in the pump area P so that only the wall portion 5 in the pump area P can be driven in the present embodiment. Thus, the wall portion 5 excluding the pump area P is not unnecessarily driven. This can prevent the resonance in the wall portion 5 by reducing the resonance points in the wall portion 5.

Note that the active electrodes 12*b* installed on the side surfaces 5*b* and 5*b* of both wall portions 5 forming a non-ejection groove 6*b* are electrically separated from each other so that each ejection groove 6*a* can independently be driven in the present embodiment. As describe above, independently driving each of the ejection grooves 6*a* can advantageously cause high-frequency driving. Note that the liquid discharge chamber 10 and the liquid supply chamber 9 may operate in a reverse way. That is, liquid may be supplied from the liquid discharge chamber 10 and discharged from the liquid supply chamber 9. In addition, it is also possible to form protection films on inner walls with which liquid comes in contact.

(Effect of Embodiment)

According to the present embodiment, the drive electrodes 12 (12*a* and 12*b*) are installed from the −X side end to a position biased to the first side from the +X side end. This can prevent the drive electrodes 12 (12*a* and 12*b*) facing to each other in the grooves 6 (6*a* and 6*b*) at the +X side end from being short-circuited, and can prevent the +X side end of the wall portion 5 from being deformed when applying a voltage to the drive electrodes 12 (12*a* and 12*b*) to drive the liquid jet head 1. Further, the drive electrodes 12 (12*a* and 12*b*) hold the first insulating film 21 and the second insulating film 22 with the wall portion 5 on both of the X direction sides. This can prevent the −X side end and the +X side end of the wall portion 5 from being deformed when applying a voltage to the drive electrodes 12 (12*a* and 12*b*) to drive the liquid jet head 1. This can deform the wall portion 5 at the periphery of the nozzle hole 11 and can prevent both of the longitudinal ends of the wall portion from being deformed when applying a voltage to the drive electrodes 12 (12*a* and 12*b*) to drive the liquid jet head 1. The pressure wave generated at the deformation of the wall portion 5 can be propagated toward both of the X direction sides around the central axis of the nozzle hole 11 in a fine balance, at the inside of the liquid with which the ejection groove 6*a* is filled, because only the wall portion 5 at the periphery of the nozzle hole 11 can be deformed. Thus, the liquid ejection characteristic can be improved.

The effective drive electrode area E that does not hold the insulating films 21 and 22 with the wall portion 5 is symmetrical with respect to the plane of the virtual surface F. Thus, when applying a voltage to the drive electrodes 12 (12*a* and 12*b*) to drive the liquid jet head 1, the wall portion 5 can be deformed so as to be symmetrical with respect to the plane of the virtual surface F. Thus, at the inside of the liquid with which the ejection groove 6*a* is filled, the pressure wave generated at the deformation of the wall portion 5 can be propagated in a fine balance so as to be symmetrical with respect to the plane of the virtual surface F. Thus, the liquid ejection characteristic can drastically be improved. Further, the part in the wall portion 5 corresponding to the area excluding the effective drive electrode area E is not unnecessarily driven. This can reduce the resonance points in the wall portion 5 when applying a voltage to the drive electrodes 12 (12*a* and 12*b*) drives the liquid jet head 1. This can prevent a resonance in the wall portion 5 when the liquid jet head 1 is driven and thus can improve the liquid ejection characteristic.

Placing both of the X direction edges of the effective drive electrode area E in the pump area P can drive only the wall portion 5 in the pump area P when applying a voltage to the drive electrodes 12 (12*a* and 12*b*) drives the liquid jet head 1. Thus, the wall portion 5 excluding the pump area P is not unnecessarily driven. This can prevent the resonance in the wall portion 5 by reducing the resonance points in the wall portion 5.

The material forming the insulating films 21 and 22 has a smaller relative permittivity than that of the piezoelectric body forming the wall portion 5 of the actuator substrate 2. This can reduce the capacitance between the first insulating films 21 and 21 holding the wall portion 5 therebetween and the capacitance between the second insulating films 22 and 22 holding the wall portion 5 therebetween when the drive electrodes 12 (12*a* and 12*b*) are installed while holding the insulating films 21 and 22 with the wall portion 5. This can surely prevent the parts in the wall portion 5 corresponding to the insulating films 21 and 22 from being driven when the liquid jet head 1 is driven. Especially, forming the insulating films 21 and 22*a* using a material mainly made of $SiO_2$ can form a highly reliable liquid jet head 1 with a beneficial adhesion of the insulating films 21 and 22 and the drive electrodes 12 (12*a* and 12*b*).

(First Variation of Embodiment)

Figure 8:
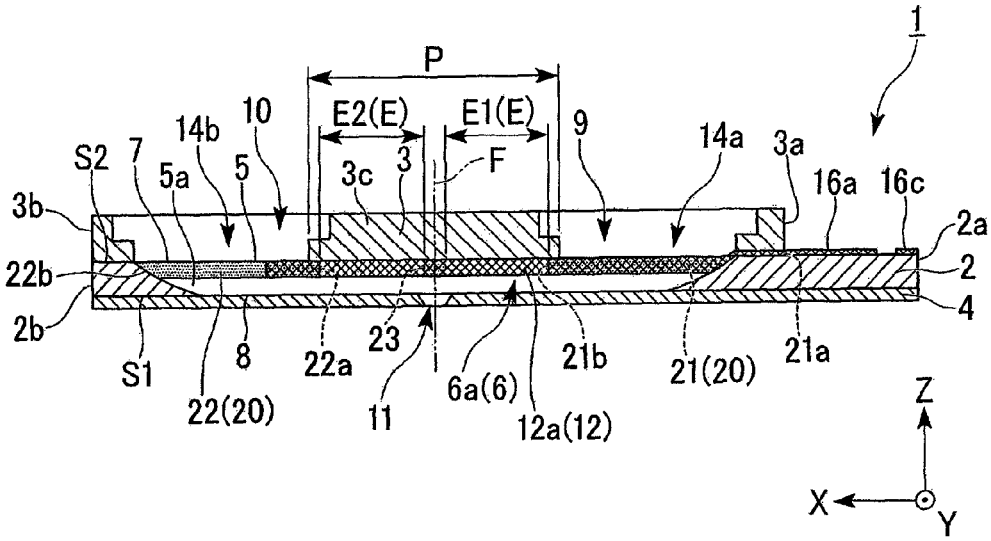
FIG. 8 is a diagram illustrating a liquid jet head according to a first variation of the embodiment.

FIG. 8 is a diagram for illustrating a liquid jet head 1 according to a first variation of the embodiment, and a side cross-sectional view of an ejection groove 6*a* taken along the X direction. Note that, for simplicity's sake, a drive electrode 12 is cross-hatched and insulating films 20 are dot-hatched in FIG. 8.

Next, the liquid jet head 1 according to the first variation of the embodiment will be described.

In the liquid jet head 1 according to the embodiment, each of the drive electrodes 12 (12*a* and 12*b*) holds a first insulating film 21 with the wall portion 5 at the −X side end, and holds a second insulating film 22 with the wall portion 5 at the +X side end (see FIG. 2A).

On the other hand, the liquid jet head 1 according to the first variation of the embodiment is different, as illustrated in FIG. 8, from the above-mentioned embodiment in that each of the drive electrodes 12 (12*a* and 12*b*) holds a first insulating film 21 with the wall portion 5 at the −X side end, holds a second insulating film 22 with the wall portion 5 at the +X side end, and further holds a third insulating film 23 with the wall portion 5 at a position corresponding to nozzle hole 11. Note that the detailed description of the same components as those of the embodiment will not be repeated and only different portions will be described.

As illustreted in FIG. 8, the third insulating film 23 is provided at the position that is between a common electrode 12*a* and a side surface 5*a* of the wall portion 5 and that corresponds to the nozzle hole 11. The third insulating film 23 has about the same width as the common electrode 12*a* in the Z direction or has a slightly wider width than the common electrode 12*a* in the Z direction. The third insulating film 23 has a predetermined length in the X direction and is formed so as to be symmetrical with respect to the plane of a virtual surface F. Note that, although not illustrated in the drawings, the third insulating film 23 is provided at the position that is between an active electrode 12*b* (see FIG. 1) and the side surface 5*a* of the wall portion 5 and that corresponds to the nozzle hole 11, similarly to the common electrode 12*a*.

The area in the drive electrode 12 (12*a* or 12*b*) that does not hold the insulating films 21, 22, and 23 with the wall portion 5 is an effective drive electrode area E in which an electric field can be generated when a voltage is applied to the drive electrodes 12 (12*a* and 12*b*). The effective drive electrode area E in the first variation is divided into a first effective drive electrode area E1 placed on the ûX side from the third insulating film 23 and a second effective drive electrode area E2 placed on the +X side from the third insulating film 23. The first effective drive electrode area El and the second effective drive electrode area E2 are provided so as to be symmetrical with respect to the plane of the virtual surface F. Thus, when applying a voltage to the drive electrodes 12 drives the liquid jet head 1, the wall portion 5 can be deformed so as to be symmetrical with respect to the plane of the virtual surface F in the same manner as the embodiment.

(Effect of First Variation of Embodiment)

According to the first variation of the embodiment, the third insulating film 23 is provided at the position that is between the drive electrode 12 (12*a* or 12*b*) and the side surface 5*a* of the wall portion 5 and that corresponds to the nozzle hole 11. This can prevent the position in the wall portion 5 corresponding to the nozzle hole 11 from being deformed and can deform the wall portion 5 at the periphery except for the position corresponding to the nozzle hole 11 when applying a voltage to the drive electrodes 12 (12*a* and 12*b*) drives the liquid jet head 1. This can propagate the pressure wave generated at the deformation of the wall portion 5 toward both of the X direction sides around the central axis of the nozzle hole 11 in a fine balance at the inside of the liquid with which the ejection groove 6*a* is filled. Further, a drive electrode is installed at the position corresponding to the nozzle hole 11 while further holding the third insulating film 23 with the wall portion 5. This can narrow the effective drive electrode area E that does not hold the insulating films 21, 22 and 23 with the wall portion 5 in the drive electrode 12 (12*a* or 12*b*) by a width of the third insulating film 23. Thus, the power consumption can be reduced while a favorable ejection characteristic is maintained.

(Second Variation of Embodiment)

Figure 9:
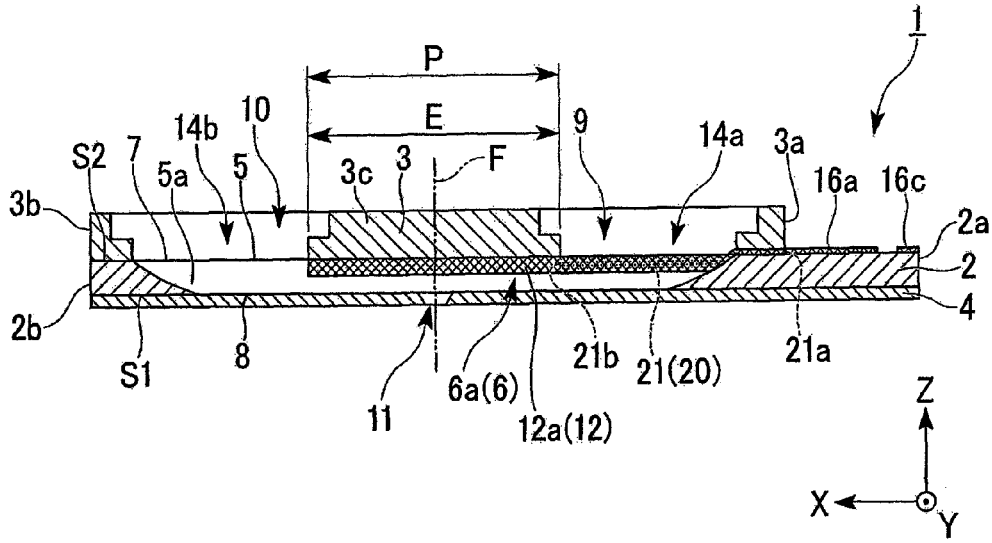
FIG. 9 is a diagram illustrating a liquid jet head according to a second variation of the embodiment.

FIG. 9 is a diagram for illustrating a liquid jet head 1 according to a second variation of the embodiment, and a side cross-sectional view of an ejection groove 6*a* taken along the X direction. Note that, for simplicity's sake, a drive electrode 12 is cross-hatched and an insulating film 20 is dot-hatched in FIG. 9.

Next, the liquid jet head 1 according to the second variation of the embodiment will be described.

In the liquid jet head 1 according to the embodiment, each of the drive electrodes 12 (12*a* and 12*b*) holds a first insulating film 21 with the wall portion 5 at the −X side end, and holds a second insulating film 22 with the wall portion 5 at the +X side end (see FIG. 2A).

On the other hand, the liquid jet head 1 according to the second variation of the embodiment is different, as illustrated in FIG. 9, from the above-mentioned embodiment in that each of the drive electrodes 12 (12*a* and 12*b*) holds only a first insulating film 21 with the wall portion 5 at the −X side end. Note that the detailed description of the same components as those of the embodiment will not be repeated and only different portions will be described.

As illustrated in FIG. 9, the +X side end of a common electrode 12*a* is placed at a position biased toward the −X side from the +X side end of the wall portion 5 in the X direction, and is placed along the +X side edge of a pump area P.

The common electrode 12*a* holds the first insulating film 21 with the wall portion 5 at the −X side end.

A +X side end 21*b* of the first insulating film 21 is placed along the boundary between the pump area P and a non-pump area corresponding to a first slit 14*a*. Note that, although not illustrated in the drawings, the +X side end of an active electrode 12*b* (see FIG. 1) is placed along the +X side edge of the pump area P, similarly to the common electrode 12*a*. The +X side end 21*b* of the first insulating film 21 placed between the common electrode 12*a* and the wall portion 5 is placed along the boundary between the pump area P and the non-pump area corresponding to the first slit 14*a*, similarly to the first insulating film 21 on the common electrode 12*a* side.

The area in the drive electrode 12 (12*a* or 12*b*) that does not hold the insulating film 21 with the wall portion 5 is an effective drive electrode area E in which an electric field can be generated when a voltage is applied to the drive electrodes 12 (12*a* and 12*b*). The area in in the drive electrode 12 (12*a* or 12*b*) corresponding to the pump area P is the effective drive electrode area E in the second variation. The effective drive electrode area E is provided so as to be symmetrical with respect to the plane of a virtual surface F. Thus, when applying a voltage to the drive electrodes 12 drives the liquid jet head 1, the wall portion 5 can be deformed so as to be symmetrical with respect to the plane of the virtual surface F in the same manner as the embodiment.

(Effect of Second Variation of Embodiment)

According to the second variation of the embodiment, the +X side end of each of the drive electrodes 12 (12*a* and 12*b*) is placed along the +X side edge of the pump area P, and the +X side end 21*b* of the first insulating film 21 is placed along the boundary between the pump area P and the non-pump area. Thus, only providing the first insulating film 21 can cause the effective drive electrode area E to be symmetrical with respect to the virtual surface F. This can reduce the cost of the insulating material in comparison with the embodiment and thus can form, at low cost, a liquid jet head 1 capable of improving the liquid ejection characteristic.

(Liquid Jet Apparatus)

Figure 10:
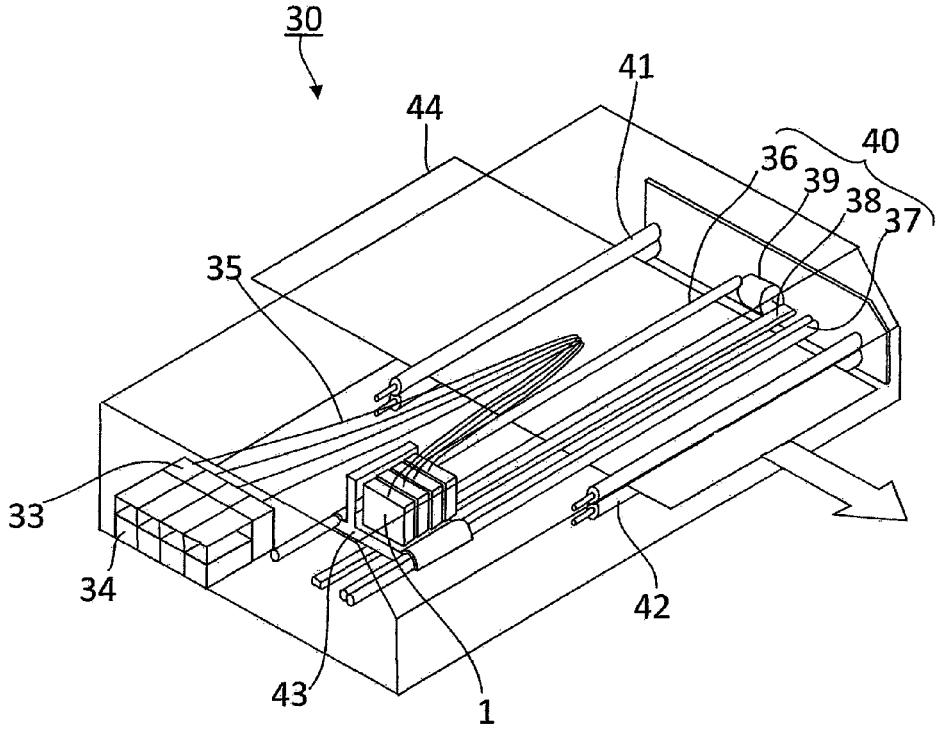
FIG. 10 is a diagram illustrating a liquid jet apparatus including the liquid jet head according to the embodiment.

FIG. 10 is a diagram illustrating a liquid jet apparatus 30 including the liquid jet head 1 according to the embodiment.

As illustrated in FIG. 10, the liquid jet apparatus 30 includes a plurality of (four in the present embodiment) liquid jet heads 1, a flow path 35 (equivalent of a "liquid supply pipe" in the accompanying claims) that supplies liquid to the liquid jet heads 1 and discharges the liquid from the liquid jet heads 1, a liquid pump 33 that supplies liquid to the flow path 35, and a plurality of (four in the present embodiment) liquid tanks 34. Each of the liquid jet heads 1 includes a plurality of head chips so as to eject liquid from the nozzle holes 11 (see FIG. 1). At least one of a supply pump that supplies liquid to the flow path 35 and a discharge pump that discharges liquid is installed as the liquid pump 33. In addition, a pressure sensor and a flow rate sensor (not shown) may be provided to control the flow rate of the liquid. One of the liquid jet heads 1 according to the above-mentioned embodiment and the variations thereof is used.

The liquid jet apparatus 30 further includes a pair of convey units 41 and 42 that convey a recording medium 44, for example, a piece of paper in a main scanning direction, a carriage unit 43 that places the liquid jet heads 1 thereon, a moving mechanism 40 that scans the liquid jet heads 1 in a vertical scanning direction perpendicular to the main scanning direction. A control unit (not illustrated in the drawings) controls the liquid jet heads 1, the moving mechanism 40, and the convey units 41 and 42 to drive them.

The pair of convey units 41 and 42 extends in the sub-scanning direction and has grid rollers and pinch rollers that rotate with the roller surfaces thereof coming in contact with each other. The grid rollers and the pinch rollers are caused to rotate about the shafts thereof by a motor (not shown) to convey the recording medium 44 held between the rollers in the main scanning direction. The moving mechanism 40 includes a pair of guide rails 36 and 37 that extend in the sub-scanning direction; the carriage unit 43 slidable along the pair of guide rails 36 and 37; an endless belt 38 that is connected to the carriage unit 43 and moves the carriage unit 43 in the sub-scanning direction; and a motor 39 that revolves the endless belt 38 via pulleys (not shown).

The carriage unit 43 places the liquid jet heads 1 thereon so as to eject, for example, four types of liquid in yellow, magenta, cyan, and black. Each of the liquid tanks 34 stores the liquid of an appropriate color so as to supply the color to each of the liquid jet heads 1 through the liquid pump 33 and the flow path 35. Each of the liquid jet heads 1 ejects each color liquid in response to a drive signal. By controlling the timings to eject the liquid from the liquid jet heads 1, the rotation of the motor 39 that drives the carriage unit 43, and the convey velocity of the recording medium 44, an arbitrary pattern can be recorded on the recording medium 44.

Note that in the liquid jet apparatus 30 according to the fifth embodiment, the moving mechanism 40 moves the carriage unit 43 and the recording medium 44 to perform recording. Alternatively, a liquid jet apparatus may be used in which a moving mechanism two-dimensionally moves a recording medium to perform recording with a carriage unit fixed. In other words, any moving mechanism that relatively moves the liquid jet head 1 and a recording medium can be used.

Note that the technical scope of the present invention is not limited to the embodiments and can variously be changed without departing from the gist of the present invention.

A flow-through type liquid jet head 1 is cited as an example in the embodiment. However, the application of the present invention is not limited to the flow-through type liquid jet head 1.

The drive electrodes 12 are placed on the side surfaces of the wall portion 5 of the actuator substrate 2 so as to be separated from the nozzle plate 4 in the embodiment. However, the range at which the drive electrodes 12 are installed is not limited to the embodiment. For example, the drive electrodes 12 can be placed close to the nozzle plate 4.

For example, a chevron structure in which piezoelectric body materials polarized in vertically opposite polarization directions to each other in the depth direction of the grooves 6 are stacked can be used for the present invention. In that case, forming the drive electrodes 12 all over the side surfaces 5*a* and 5*b* of the wall portion 5 bends and deforms the top and bottom of the wall portion 5 into a V shape around the middle position in the height direction of the wall portion 5 by piezoelectric shear effect. This can deform the wall portion 5 at a low voltage.

The ejection groove 6*a* and the non-ejection groove 6*b* are alternately arranged as the grooves 6 in the embodiment. The formation of the grooves 6 is not limited to the embodiment. For example, it is not necessary to alternately arrange the ejection groove 6*a* and the non-ejection groove 6*b*. Channel lines 6 can include only ejection channels 6*a* without the non-ejection grooves 6*b*.

The +X side end 21*b* of the first insulating film 21 and the −X side end 22*a* of the second insulating film 22 are placed in the pump area P, and both of the X direction edges of the effective drive electrode area E are placed in the pump area P in the embodiment. This causes the effective drive electrode area E to be symmetrical with respect to the plane of the virtual surface F.

Alternatively, for example, the +X side end 21*b* of the first insulating film 21 and the −X side end 22*a* of the second insulating film 22 are respectively placed along the boundary between the pump area P and the non-pump area, and the effective drive electrode area E is placed at the same area as the pump area P. This can also cause the effective drive electrode area E to be symmetrical with respect to the plane of the virtual surface F. For example, the +X side end 21*b* of the first insulating film 21 and the −X side end 22*a* of the second insulating film 22 is placed slightly outside the pump area P, and both of the X direction edges of the effective drive electrode area E are placed outside the pump area P. This can also cause the effective drive electrode area E to be symmetrical with respect to the plane of the virtual surface F. In any case, the effective drive electrode area E formed so as to be symmetrical with respect to the plane of the virtual surface F can achieve the function effects in the embodiment.

In addition, components in the above-mentioned embodiments can properly be replaced with known components without departing from the claimed invention.

What is claimed is:

1. A liquid jet head comprising:

an actuator substrate having a plurality of grooves that are divided by a wall portion made of a piezoelectric body and that penetrate a first main surface and a second main surface of the actuator substrate; and a nozzle plate which is installed on the actuator substrate so as to cover an opening on the first main surface of the grooves, and which includes nozzle holes communicated with the grooves at their longitudinal middle portion;

wherein a drive electrode extending from a first longitudinal end to a second longitudinal end in the longitudinal direction and an insulating film covering a part of a side surface of the wall portion are provided on the side surface of the wall portion, and wherein the insulating film is provided between the drive electrode and the wall portion at least at the first longitudinal end.

2. The liquid jet head according to claim 1, wherein the drive electrode is separated from the nozzle plate.

3. The liquid jet head according to claim 1, wherein the drive electrode holds the insulating film with the wall portion at both of the longitudinal ends.

4. The liquid jet head according to claim 1, wherein the drive electrode further holds the insulating film with the wall portion at a position corresponding to the nozzle hole.

5. The liquid jet head according to claim 1, wherein an effective drive electrode area of the drive electrode that does not hold the insulating film with the wall portion is provided so as to be symmetrical with respect to a plane of a virtual surface which is perpendicular to the longitudinal direction and which includes a central axis of the nozzle holes.

6. The liquid jet head according to claim 5, further comprising a cover plate which is installed on the actuator substrate so as to cover an opening on the second main surface of the grooves, and which includes a liquid supply chamber that supplies a liquid to the grooves;

wherein a predetermined area of the grooves which is a periphery of the nozzle holes and which is an area excluding an area corresponding to the liquid supply chamber is a pump area, and both of longitudinal edges of the effective drive electrode area are placed in the pump area.

7. The liquid jet head according to claim 5, further comprising a cover plate which is installed on the actuator substrate so as to cover an opening on the second main surface of the grooves, and which includes a liquid supply chamber that supplies a liquid to the grooves;

wherein a predetermined area of the grooves which is a periphery of the nozzle holes and which is an area excluding an area corresponding to the liquid supply chamber is a pump area, and both of longitudinal ends of the effective drive electrode area are placed along a boundary between the pump area and a non-pump area.

8. The liquid jet head according to claim 6, wherein the cover plate includes a liquid discharge chamber that discharges the liquid from the grooves, the liquid supply chamber is communicated with the first longitudinal end of the grooves, the liquid discharge chamber is communicated with the second longitudinal end of the grooves, and an area of the grooves corresponding to an area between the liquid supply chamber and the liquid discharge chamber is the pump area.

9. The liquid jet head according to claim 8, wherein the grooves are ejection grooves and non-ejection grooves that are alternately arranged, and the liquid supply chamber and the liquid discharge chamber are communicated with the ejection grooves.

10. The liquid jet head according to claim 1, wherein a material forming the insulating film has a smaller relative permittivity than that of the piezoelectric body forming the wall portion.

11. The liquid jet head according to claim 1, wherein the material forming the insulating film is mainly made of $SiO_2$.

12. A method for producing the liquid jet head according to claim 1, the method comprising:

installing an insulating film mask on a piezoelectric body substrate;

forming a film of an insulating material on the piezoelectric body substrate;

installing a drive electrode mask having an opened part corresponding to an area on which a film of the drive electrode is to be formed; and forming a film of a piezoelectric material of the drive electrode.

13. A liquid jet apparatus, comprising:

the liquid jet head according to claim 1;

a moving mechanism configured to move the liquid jet head and a recording medium relative to each other;

a liquid supply tube configured to supply liquid to the liquid jet head; and a liquid tank configured to supply the liquid to the liquid supply tube.

14. A liquid jet head comprising:

an actuator substrate having opposed main surfaces and longitudinally extending grooves that extend through the actuator substrate from one main surface to the other main surface, the grooves being separated from one another by wall portions made of piezoelectric material;

a nozzle plate attached to the one main surface of the actuator substrate and covering openings of the grooves that open at the one main surface, the nozzle plate having nozzle holes that communicate with respective grooves at a longitudinal middle portion of the grooves;

drive electrodes provided on respective wall portions of the grooves and extending longitudinally therealong from one longitudinal end portion of the grooves to beyond the longitudinal middle portion of the grooves; and an insulating film disposed between the drive electrodes and the wall portions of the grooves at least at the one longitudinal end portion of the grooves for electrically insulating the drive electrodes from the wall portions of the grooves.

15. The liquid jet head according to claim 14; wherein the insulating film is formed on the wall portions of the grooves at both longitudinal end portions of the grooves, and the drive electrodes extend longitudinally from the one longitudinal end portion to the other longitudinal end portion of the grooves over the insulating film at both longitudinal end portions of the grooves.

16. The liquid jet head according to claim 15; wherein the insulating film is also formed on the wall portions of the grooves at positions corresponding to the nozzle holes, and the drive electrodes extend over the insulating film formed at these positions.

17. The liquid jet head according to claim 14; wherein the insulating film is also formed on the wall portions of the grooves at positions corresponding to the nozzle holes, and the drive electrodes extend over the insulating film fomed at these positions.

18. The liquid jet head according to claim 14; wherein the insulating film extends longitudinally only partway along the grooves from one or both longitudinal end portions of the grooves toward the longitudinal middle portion of the grooves.

19. The liquid jet head according to claim 18; wherein the drive electrodes have an area on both sides of the longitudinal middle portion of the grooves where the insulating film is not present and where the drive electrodes directly contact the wall portions of the grooves.

20. A liquid jet apparatus, comprising:

the liquid jet head according to claim 14;

a mechanism configured to move the liquid jet head and a recording medium relative to each other; and means for supplying liquid to the liquid jet head.

* * * * *